United States Patent [19]

Hester

[11] 4,185,775

[45] Jan. 29, 1980

[54] PORTABLE AIRLESS SPRAYING DEVICE

[76] Inventor: Delta R. Hester, 9743 Lucore, Houston, Tex. 77017

[21] Appl. No.: 826,476

[22] Filed: Aug. 22, 1977

[51] Int. Cl.[2] ..... B05B 7/24

[52] U.S. Cl. ..... 239/308; 239/373

[58] Field of Search ..... 239/308, 373

[56] References Cited

U.S. PATENT DOCUMENTS

| | | | |
|---|---|---|---|
| 987,545 | 3/1911 | Brorby | 239/373 X |
| 2,804,259 | 8/1957 | Ralston | 239/373 X |
| 2,889,997 | 6/1959 | Gallo | 239/308 |
| 2,976,897 | 3/1961 | Beckworth | 239/373 X |
| 3,026,045 | 3/1962 | Reading | 239/373 X |
| 3,265,308 | 8/1966 | Hopkins | 239/373 X |
| 3,977,602 | 8/1976 | Kirch | 239/308 X |

*Primary Examiner*—Robert B. Reeves
*Assistant Examiner*—Andres Kashnikow
*Attorney, Agent, or Firm*—Guy E. Matthews

[57] ABSTRACT

A portable airless spraying device using an airless spray gun for spraying paint and a hose mounted with the spray gun for carrying paint to the gun is disclosed. The device includes a vessel having a dividing wall to provide a first compartment within the vessel which holds a quantity of paint and a second compartment within the vessel for holding pressurized gas. A gas inlet is mounted with the second compartment of the vessel for receiving a supply of gas and a paint inlet is mounted with the first compartment of the vessel for receiving paint. Coupling apparatus is mounted with the first compartment for mounting the hose to the vessel and a pick-up tube is mounted within the first compartment of the vessel with an inlet in close proximity to the bottom of the first compartment and an outlet mounted with the coupling apparatus. A conduit is mounted within the vessel and leads from the second compartment to the first compartment for carrying pressurized gas from the second compartment to the first compartment and pushing the paint from the first compartment through the pick-up tube and hose to the airless spray gun.

3 Claims, 3 Drawing Figures

PORTABLE AIRLESS SPRAYING DEVICE

BACKGROUND AND BRIEF SUMMARY OF THE INVENTION

The techniques of spraying paint by airless spray devices is well known. These devices are called airless because no air or gas is mixed with the paint during spraying. The fluid is forced under sufficient pressure to pass through an aperture in a nozzle which causes atomization of the fluid, the density and velocity of the fluid passing through the nozzle being conventionally regulated by using a needle valve extending into the aperture of the nozzle.

Airless spraying devices have several advantages over other forms of spray painting, such as the paint dries faster than air mixed techniques because no air is mixed in the paint. Further, since a minimum number of moving parts are used inside the airless spray devices, the possibility of sparks are inhibited, thus, airless spraying is recommended for inside chemical plants. Further, an airless spray gun provides a more aimable and directional spray than other spray guns, which permits the spraying of more paint in less time and inhibits the necessity of additional coats of paint. The major problem with airless spraying devices has been the use of high pressures, upwards of 1500 psi, to force the paint through the gun. These high pressures can frequently cause penetration of paint through the skin of careless painters and damage surfaces being painted. Moreover, these high pressures require a continuously operating compressor and heavily reinforced structures to handle these high pressures. Thus, the devices are quite expensive because of the amount of equipment and construction of equipment. Further, these prior art airless spray devices are not portable because heavy hoses extend from the compressor to the paint source and from the paint source to the spray gun. This requires a painter to fix a position from which to paint around and then drag heavy hoses after him while painting.

Accordingly, it is an object of the present invention to provide a portable airless spraying device which permits movement to relatively inaccessible locations for spraying.

Further, it is an object of the present invention to provide a portable airless spraying device that is designed to be inexpensive and portable by eliminating some of the structure used in prior art airless spraying devices.

Further, it is an object of the present invention to provide a portable spray device that uses low gas pressures and does not mix the gas with the paint during spraying.

Further, it is an object of the invention to provide a portable airless spray device that uses a limited number of moving parts.

Further, it is an object of the present invention to provide a portable airless spray device that is aimable and directional in applying paint.

In accordance with the invention, a portable airless spraying device using an airless spray gun for spraying paint and a hose mounted with such spray gun for carrying paint to the gun is disclosed. The device includes a vessel having a dividing wall to provide a first compartment within the vessel for holding a quantity of paint and a second compartment within the vessel for holding pressurized gas. A gas inlet apparatus is mounted with the second compartment of the vessel for receiving gas from a gas supply mechanism and a paint inlet apparatus is mounted with the first compartment of the vessel for receiving paint. A coupling mechanism is mounted with the first compartment to mount the hose to the vessel and a pick-up tube is mounted within the first compartment of the vessel with an inlet in close proximity to the bottom of the first compartment and an outlet mounted with the coupling mechanism. Conduit apparatus is mounted with the vessel and leads from the first compartment to the second compartment to carry pressurized gas from the second compartment to the first compartment for pushing the paint from the first compartment through the pick-up tube and hose to the airless spray gun.

BRIEF DESCRIPTION OF THE DRAWINGS

Other objects and advantages of the invention will become apparent upon reading the following detailed description and upon reference to the drawings, in which.

Figure 1:
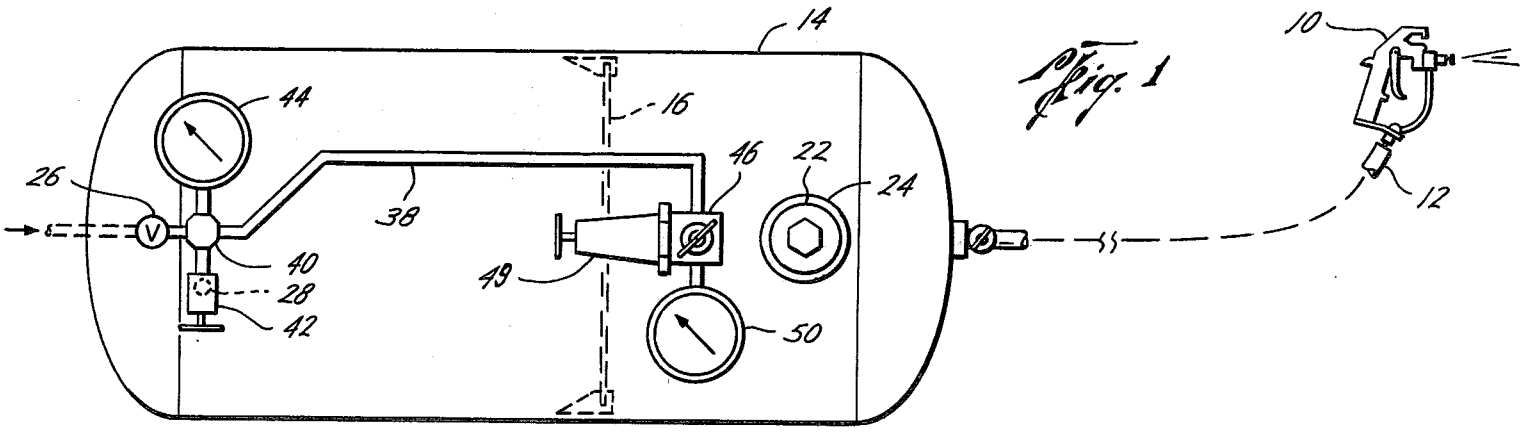
FIG. 1 is a top plan view of an embodiment constructed according to the present invention.
Figure 2:
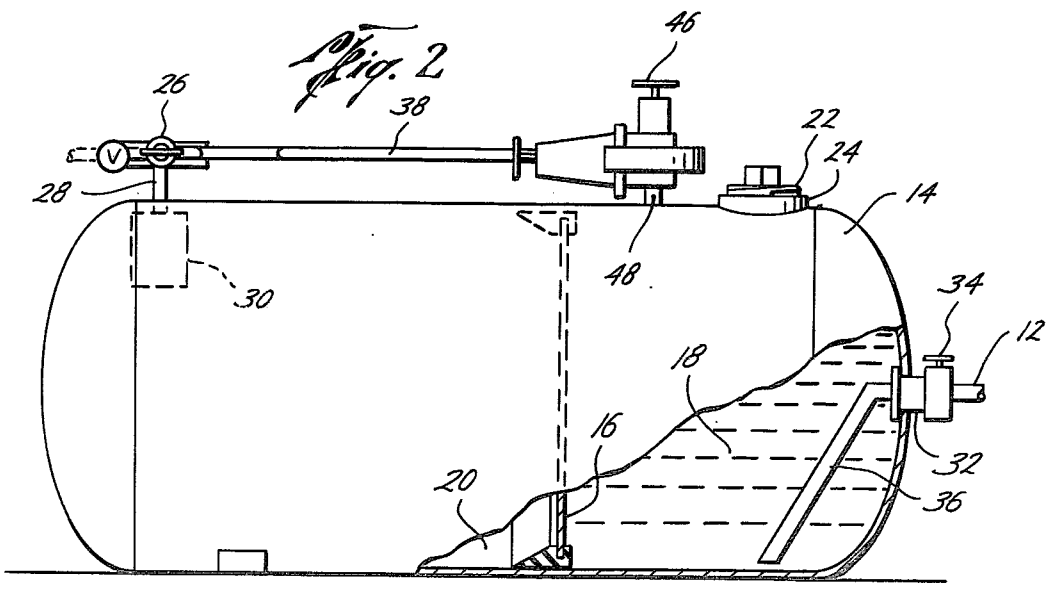
FIG. 2 is a side elevational view, partly in section, of the embodiment illustrated in FIG. 1.
Figure 3:
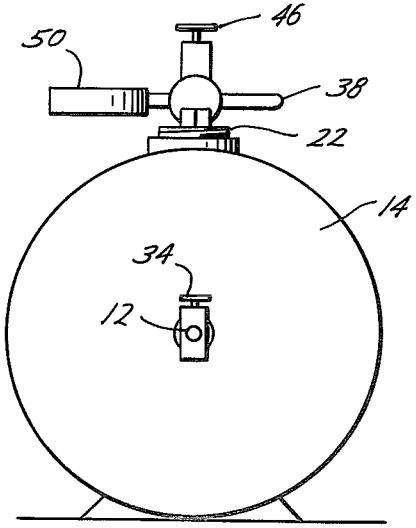
FIG. 3 is a front elevational view of an embodiment of the invention illustrated in FIG. 2.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Turning now to the drawings, a portable airless spraying device is shown having an airless spray gun 10 mounted with a hose 12 carrying paint from a vessel 14 to gun 10. Airless spray gun 10 is of conventional airless paint spraying design, such as that manufactured by Graco.

Vessel 14 has a dividing wall 16 mounted therein to provide a first compartment 18 for holding a quantity of paint and a second compartment 20 for holding pressurized gas. Preferably, dividing wall 16 is mounted within vessel 14 such that the volume of the vessel is divided with paint compartment 18 having 40% of the volume and gas compartment 20 having 60% of the volume, an increase of 50% over the volume of compartment 18. Or, it may be stated that paint compartment 18 defines a first volume capacity and the gas compartment 20 defines a second capacity, the ratio of the first capacity to the second capacity being about 2 to 3. Most preferred, paint compartment 18 defines a volume capacity capable of holding approximately $3\frac{1}{2}$ gallons of paint and gas compartment 20 defines a volume capacity capable of holding approximately 50% more. Since the device is to be portable, it is desirable that the weight of vessel 14 be limited. Thus, it is preferred that vessel 14 be constructed to withstand internal pressures of approximately 300 psi, which pressure is sufficient to force the $3\frac{1}{2}$ gallons of paint from first compartment 18 through gun 10.

A paint inlet mechanism is mounted with first compartment 18 of vessel 14 to provide paint therein. The paint inlet mechanism is preferably a plug 22 threaded into a port 24 located on the top of vessel 14. Plug 22 has a pressure release device provided therein to aid in removing the plug from the port when vessel 14 is pressurized.

A gas inlet mechanism is mounted with second compartment 20 to provide gas therein from a higher gas pressure source, shown in dotted outline. The gas inlet mechanism is preferably a check valve 26 mounted in fluid communication with a conduit 28, which is mounted with vessel 14 to provide gas communication into second compartment 20. This inlet mechanism permits the addition of gas to second compartment 20 and then disconnection from the higher gas pressure source to aid in making the airless spraying device portable. The gas used may be selected to inhibit coaction with or contamination of the paint. However, gas dryer 30 is preferably mounted within second compartment 20 to receive gas from conduit 28 for removing moisture from the gas, which may contaminate the paint.

A coupling mechanism 32 is mounted within first compartment 18. The coupling mechanism connects hose 12 to vessel 14 and puts gun 10 in fluid communication with the paint disposed within first compartment 18. Preferably, coupling mechanism 32 is located in the front end of vessel 14 at an axis of symmetry extending through the vessel. More preferred, a shut-off valve 34 is mounted with coupling mechanism 32 to prevent fluid flow into hose 12.

A pick-up tube 36 is mounted within first compartment 18 of vessel 14 for directing fluid flow from first compartment 18 to coupling mechanism 32 and hose 12. Pick-up tube 36 has an inlet located in close proximity to the bottom of first compartment 18 for receiving paint therein and an outlet mounted with coupling mechanism 32 which places gun 10 in fluid communication with the paint in first compartment 18. Preferably, pick-up tube 36 is constructed with an elbow between two straight portions of unequal length, the shorter straight portion being connected to coupling mechanism 32 and the longer straight portion extending into the inlet.

Conduit apparatus 38 is mounted with vessel 14 and leads from second compartment 20 to first compartment 18 for placing the two compartments in gas communication by carrying the pressurized gas from second compartment 20 to first compartment 18 which pushes the paint from first compartment 18 through pick-up tube 18 and hose 12 to airless spray gun 10. Preferably, conduit apparatus 38 is mounted at one end to a pipe cross 40 which is in fluid communication with the check valve 26. In addition to check valve 26 being mounted to a first passageway of cross 40 and conduit apparatus 38 mounted to a second passageway, pipe cross 40 has a third passageway mounted to a shutoff valve 42 for preventing gas flow into and out of second compartment 20 and a fourth passageway mounted to a first pressure gauge 44 for indicating the gas pressure in conduit apparatus 38 and second compartment 20. The other end of conduit apparatus 38 is mounted to a shut-off valve 46 connected to a conduit 48, which is mounted with vessel 14 to provide fluid communication into first compartment 18. A gas pressure regulator 49 is mounted with shut-off valve 46 to control the pressure of the gas flowing into first compartment 18 and a second pressure gauge 50 is mounted with shut-off valve 46 to measure the pressure provided within first compartment 18. By such construction, the gas pressure within each compartment can be measured independently of one another and conduit apparatus 38 can be disconnected from both compartments when repairs must be made.

In operation, plug 22 is removed from port 24 to supply paint in first compartment 18 of vessel 14. If under pressure, the pressure release mechanism is depressed to permit the release of pressure within compartment 18 and plug 22 is easily removed. When the desired amount of paint has been added, plug 22 is reinserted into port 24 to stopper the opening. First shut-off valve 42 is opened and second shut-off valve 46 is closed and gas is added through check valve 26 into first compartment 20 until the desired pressure is provided, as shown on pressure gauge 44. It is preferred that this pressure is less than 300 psi because of the preferred weight limitation in construction. First valve 42 is then closed and the higher pressure source being disconnected from check valve 26. The portable spraying device is then taken to the desired location for use and first and second shut-off valves 42 and 46 are opened. Pressure regulator 49 regulates the pressure supplied to the paint within first compartment 18, which forces the paint to flow through hose 12 to gun 10. The paint is then applied when the operator depresses the trigger or gun 10.

Thus, it is apparent that there has been provided, in accordance with the invention, a portable airless spraying device that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A portable spraying device using an airless spray gun for spraying paint and a hose mounted with said spray gun for carrying paint to said gun, comprising:

a single vessel movable to relatively inaccessible locations for spraying, said vessel being constructed to withstand a gas pressure of approximately 300 psi and having a dividing wall to provide a first compartment for holding approximately 3½ gallons of paint and a second compartment for holding pressurized gas which defines a volume capable of holding approximately 50 percent more than the first compartment;

paint inlet means mounted with said vessel for receiving paint into the first comparment;

coupling means mounted with the first compartment for mounting the hose to said vessel;

a pick-up tube mounted within the first compartment of said vessel for carrying paint to said coupling means, said tube having an inlet in close proximity to the bottom of the first compartment to receive paint therein and an outlet mounted with said coupling means; gas inlet means mounted with said vessel for receiving gas from gas supplying apparatus into the second compartment;

a gas dryer mounted with said gas inlet means for removing moisture from the gas to inhibit potential contamination of the paint;

conduit means mounted with said vessel and leading from the second compartment to the first compartment for carrying the pressurized gas from the second compartment to the first compartment to push the paint through the pick-up tube and hose to said airless spray gun;

first and second pressure gauges mounted with said conduit means for indicating the amount of gas pressure in the first and second compartments independently of one another; and first and second shutoff valves mounted with said conduit means for stopping the flow of pressurized gas out of the first and second compartments to permit disconnection of said conduit means from both compartments when repairs are to be made.

2. The portable spraying device of claim 1, including a gas regulator mounted with said conduit means for controlling the amount of gas pressure entering the first compartment from the second compartment.

3. The portable spraying device of claim 2, including a check valve mounted with said gas inlet means for permitting the addition of gas to the second compartment and then disconnection from the gas supplying apparatus.

* * * * *